United States Patent [19]

Hantover

[11] Patent Number: 5,054,828

[45] **Date of Patent: * Oct. 8, 1991**

[54] DOG FECES DISPOSAL IMPLEMENT KIT

[76] Inventor: Bruce Hantover, 9613 Aurora Ave. N, Seattle, Wash. 98103

[ * ] Notice: The portion of the term of this patent subsequent to Mar. 20, 2007 has been disclaimed.

[21] Appl. No.: 495,237

[22] Filed: Mar. 16, 1990

Related U.S. Application Data

[63] Continuation-in-part of Ser. No. 313,928, Feb. 22, 1989, Pat. No. 4,909,553.

[51] Int. Cl.[5] ..... A01K 29/00

[52] U.S. Cl. ..... 294/1.3; 15/257.1; 229/103; 206/627; 294/55

[58] Field of Search ..... 294/1.3–1.5, 294/25, 55; 15/104.8, 257.1, 257.2; 229/103; 206/627

[56] References Cited

U.S. PATENT DOCUMENTS

| | | | |
|---|---|---|---|
| D. 257,406 | 10/1980 | Ouellette | 294/1.3 X |
| 3,286,826 | 11/1966 | Stoll | 206/47 |
| 3,639,937 | 2/1972 | Sweeney | 294/1.3 X |
| 3,765,044 | 10/1973 | Hanahan et al. | 294/1.3 X |
| 3,767,247 | 10/1973 | Wetzler | 294/1 R |
| 3,978,540 | 1/9976 | Peck et al. | 15/104.8 |
| 3,995,807 | 12/1976 | Dell'Anno | 294/1.3 |
| 4,103,952 | 8/1978 | Thompson | 294/1 R |
| 4,205,869 | 6/1980 | Mathis | 294/1 B |
| 4,272,116 | 6/1981 | Tufte, Jr. | 294/1 B |
| 4,380,289 | 4/1983 | Bigelow | 294/55 X |
| 4,635,843 | 1/1987 | Tomlinson | 294/55 X |
| 4,809,390 | 3/1989 | Jackson et al. | 294/1.3 X |
| 4,909,553 | 3/1990 | Hantover | 294/1.3 |

FOREIGN PATENT DOCUMENTS

| | | | |
|---|---|---|---|
| 2556560 | 6/1985 | France | 294/1.3 |

*Primary Examiner*—Margaret A. Focarino
*Assistant Examiner*—Joseph D. Pape
*Attorney, Agent, or Firm*—Robert W. Beach; Ward Brown

[57] ABSTRACT

A scoop component includes two leaves extending opposite from each other and having adjacent ends joined by a tear line, which tear line may be interrupted by an apertured cutout tab projecting from one of the leaves, which leaves have folding lines flaring from locations on the tear line spaced from its ends, respectively, toward the corners of the ends of the leaves opposite the tear line.

9 Claims, 6 Drawing Sheets

Fig. 1
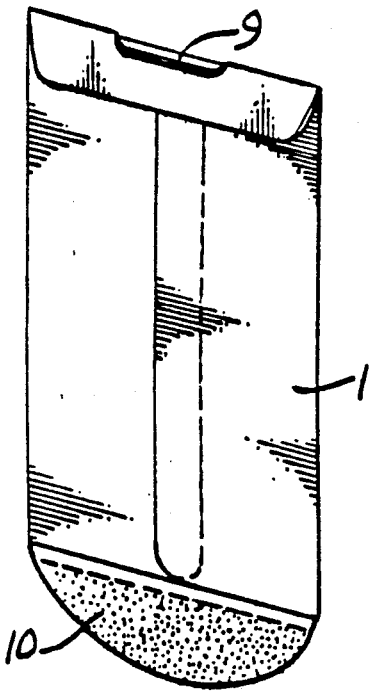
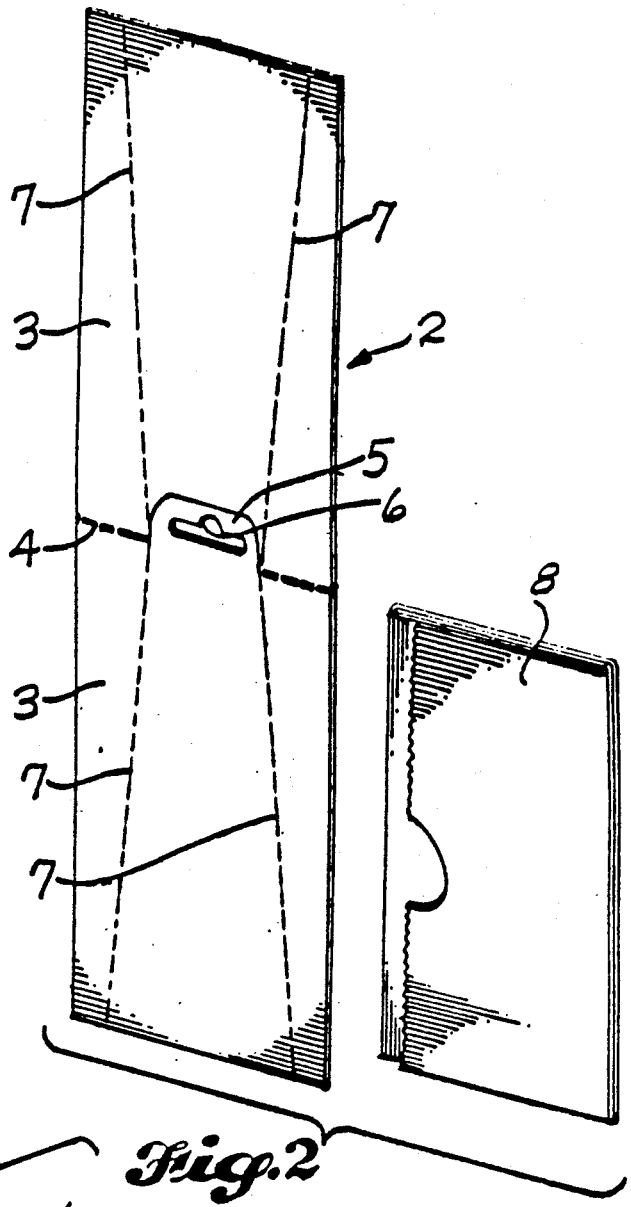
Fig. 2
Fig. 3
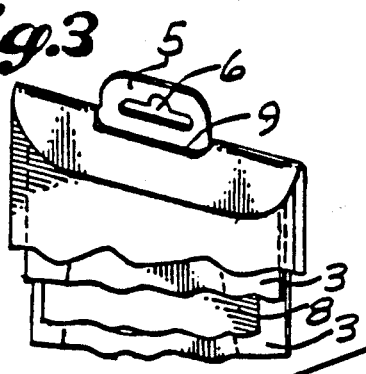
Fig. 4
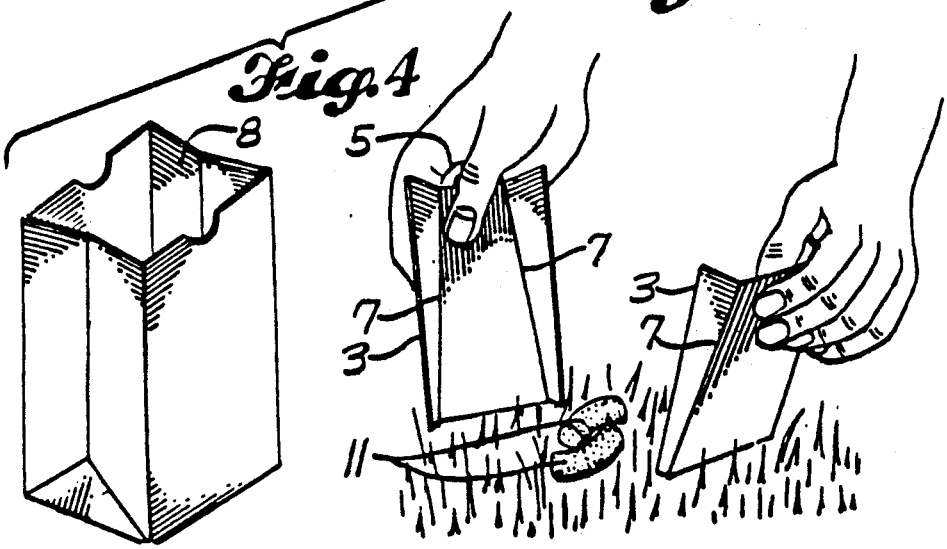

DOG FECES DISPOSAL IMPLEMENT KIT

CROSS REFERENCE

This application is a continuation-in-part of my copending U.S. patent application Ser. No. 07/313,928, filed Feb. 22, 1989, for Dog Feces Disposal Implement Kit issued as U.S. Pat. No. 4,909,553 on Mar. 20, 1990.

BACKGROUND OF THE INVENTION

1. Field of the Invention

The present invention relates to a kit of implements for disposing of dog feces by picking up such feces and depositing the feces into a disposable container to be transported to a waste-collection receptacle.

2. Problem

The problem solved by the present invention is the disposal of excrement dropped by a dog, particularly while being walked on a leash. In many cities it is unlawful for a dog to be outside of the owner's premises without being on a leash. Consequently it is customary for dogs to be walked while being tethered on a leash. During such walking the dog may defecate. In many cities it is also unlawful for a person walking a dog to fail to remove excrement which may be deposited by a dog while it is being walked. Such removal may be difficult to accomplish in a sanitary manner and without embarrassment.

2. Prior Art

A number of proposals have been made to solve this problem. Apparatus which is comparatively complicated and expensive is disclosed in the following U.S. patents:

Wetzler U.S. Pat. No. 3,767,247, issued Oct. 23, 1973
Peck et al. U.S. Pat. No. 3,978,540, issued Sept. 7, 1976
Thompson U.S. Pat. No. 4,103,952, issued Aug. 1, 1978.

For the most part, the devices of these patents are considered to be impractical.

The form of device shown in FIG. 13 of U.S. Pat. No. 3,767,247 mentioned above is more practical, are the devices disclosed in the following U.S. patents:

Stoll U.S. Pat. No. 3,286,826, issued Nov. 22, 1966
Mathis U.S. Pat. No. 4,205,869, issued June 3, 1980
Tufte, Jr. U.S. Pat. No. 4,272,116, issued June 9, 1981

These devices, however, are generally more bulky to carry, more difficult to convert to usable condition and more difficult to use than the kit of the present invention.

SUMMARY OF THE INVENTION

A principal object of the present invention is to be able to remove and dispose of dog feces quickly and easily and with a minimum of embarrassment.

An object of the invention is to provide in such kit implements which are compact when being carried, but which can be prepared for use quickly and easily and after use may be discarded.

Another object is to provide such implements of a feces disposal kit which are handy and easy and quick to use for picking up and disposing of dog feces.

It is also an object to provide such components for a feces disposal kit that are made of inexpensive material and which implements can be fabricated economically into the respective kit components.

A further object is to utilize a cardboard box, such as a pet food box, for making blanks from which components of the disposal implement kit can be fabricated.

The foregoing objects can be accomplished by providing a feces disposal implement kit which can be carried easily and unobtrusively by a dog walker. Such kit includes scoops for picking up dog feces to be deposited in a disposable receptacle for storing the feces temporarily while being transported to a disposal site such as a waste-collection receptacle.

BRIEF DESCRIPTION OF THE DRAWINGS

FIG. 1 is a top perspective of a container for a dog feces disposal kit, and FIG. 2 is a top perspective of components of the kit, one being shown unfolded.

FIG. 3 is a fragmentary top perspective of a portion of the kit shown in packed condition, and FIG. 4 is a top perspective of components of the kit in use.

DETAILED DESCRIPTION

Figure 5:
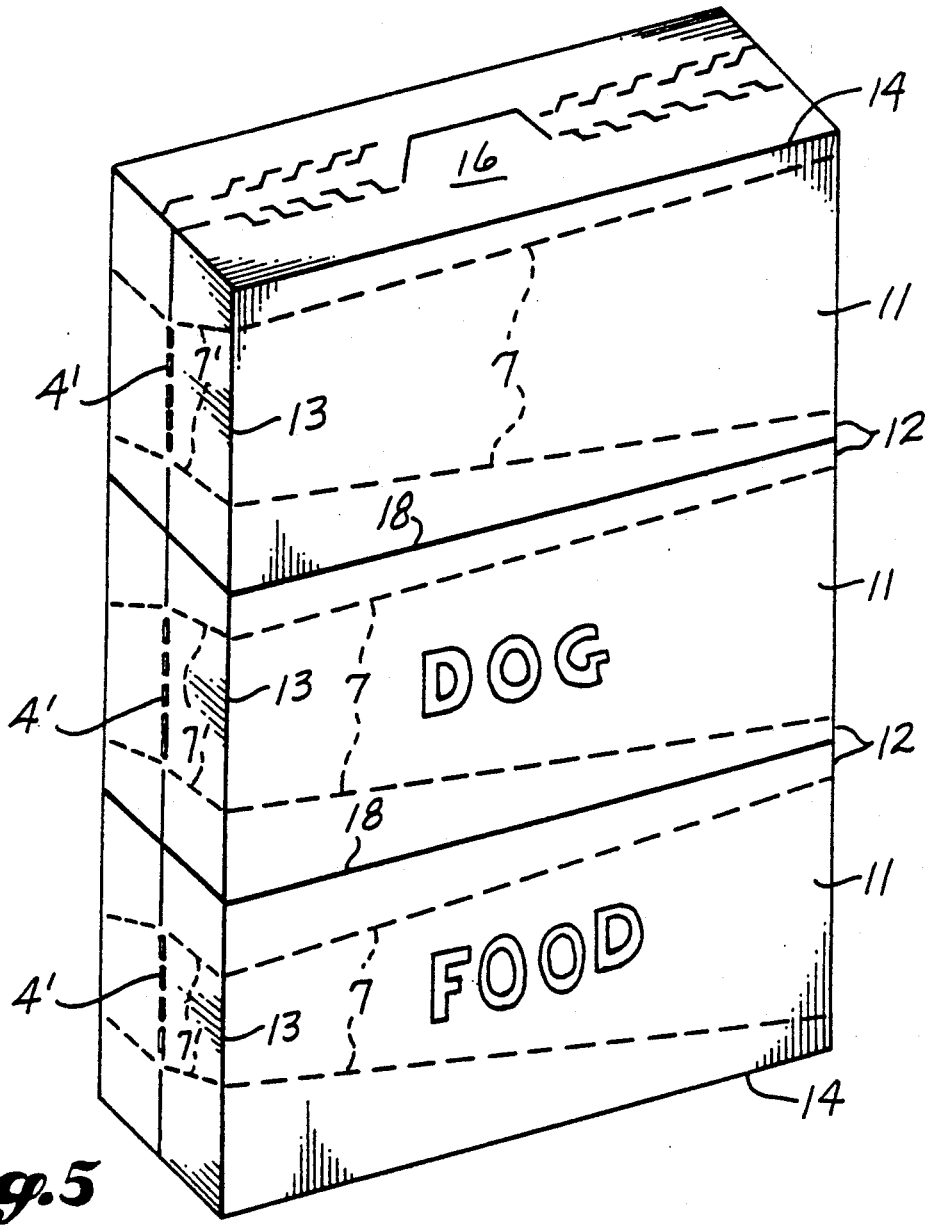
FIG. 5 is a top perspective of a pet food box from which components of the disposal kit can be fabricated.

The dog feces disposal kit may be composed of a pack of three components. The first component is an envelope 1 for receiving the other two components. The second component is the double scoop component 2 shown in FIG. 2 which is composed of two leaves 3 connected in end-to-end relationship by a combined folding and tear line 4. The central portion of this tear line is interrupted by a cutout tab 5 having an aperture 6.

When the leaves 3 are folded about the folding line 4 into back-to-back registration, the tab will project beyond the folding line as shown in FIG. 4.

At least one and preferably both of the double scoop component leaves 3 has folding lines 7 flaring from the central folding and tear line 4 at opposite sides of the tab 5 toward the opposite corners of the panel ends. Prior to being prepared for use, however, the portions of the leaves at opposite sides of such folding lines would be coplanar.

The third component of the kit is a paper receptacle sack 8 preferably of biodegradable paper material. Such sack is conventional and will be folded to a size somewhat less than the size of a leaf 3 of the double scoop component.

The envelope 1 in which the scoop component 2 and sack 8 are to be received has a central slot 9 in one end of a width and length to enable the tab 5 to pass edgewise through it. The opposite end of the envelope can be closed by a gummed flap 10 bearing adhesive which can be either of the pressure-sensitive type or can be adhesive that is activated by being moistened.

In preparing the kit for merchandizing, the two leaves 3 of the double scoop component 2 are folded toward each other about the folding and tear line 4 into back-to-back registration with the tab 5 projecting beyond the folding and tear line 4. The folded bag 8 is then placed between the folded leaves and the pack formed by the scoop and bag components is inserted tab first past the flap 10 of the envelope 1 into its interior. The pack is then pushed into the envelope until the tab 5 projects through the slot 9 in the opposite end of the envelope as shown in FIG. 3. The flap 10 can then be folded over the open end of the envelope to close it and bonded to the envelope body. The aperture 6 in the projecting tab 5 can be placed over a rod or hook to hang the package for display purposes.

The kit contained in the envelope may be from two to three inches wide and from four to six inches long so that it can be carried conveniently in a pocket or purse.

When it is desired to prepare the kit components for use, the end of the envelope 1 opposite the slot 9 can be cut open, torn open or the flap 10 can be pulled open to provide access to the contents of the envelope for removal.

The leaves 3 of the double scoop component can be opened out and the folding and tear line 4 can be severed to provide two scoop elements. The edge portions of each scoop element can be folded about the folding lines 7 through an angle of 45 to 90 degrees relative to the central panel of the leaf to the shape indicated in FIG. 4. The bag 8 can be unfolded and set on the ground adjacent to feces to be scavenged as shown in FIG. 4. The scoop leaves 3 can then be held one in each hand and one scoop element can be used to load the feces onto the other scoop element, or one leaf can be used to block feces while they are scooped up by the other scoop element. The feces thus held in one scoop element, or clamped between the two scoop elements, can be deposited in the bag 8. The used scoop elements also can be placed in the bag and the bag closed for temporarily storing the feces and scoop elements until the bag is deposited in a suitable refuse container.

An advantage to the kit is that all of the components are disposable and preferably composed of biodegradable material so that the kit elements are used only once in the manner described above and then discarded.

Figure 6:
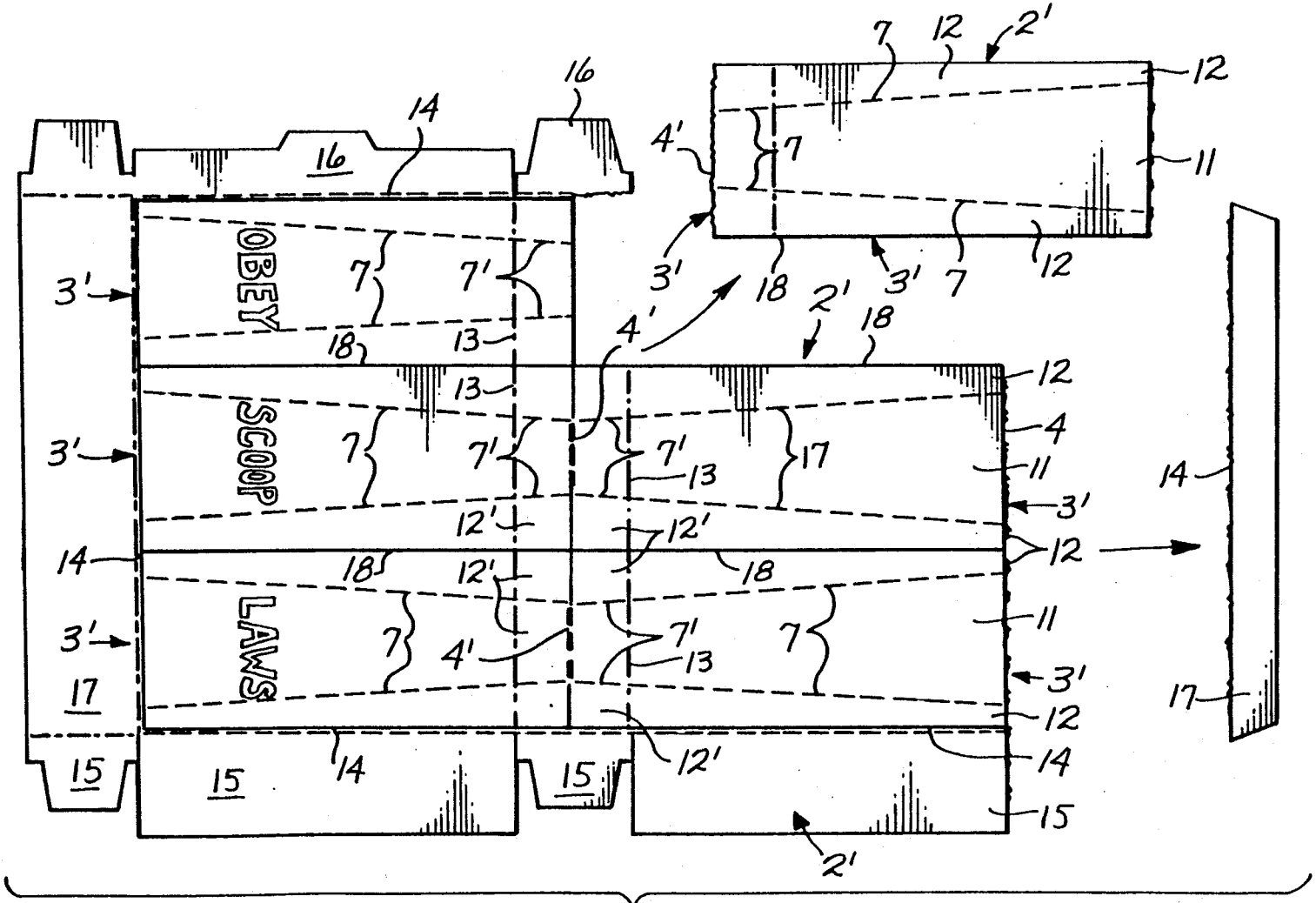
FIG. 6 is a plan of a blank made from a box like that shown in FIG. 5 for forming dog feces disposal kit components.
Figure 9:
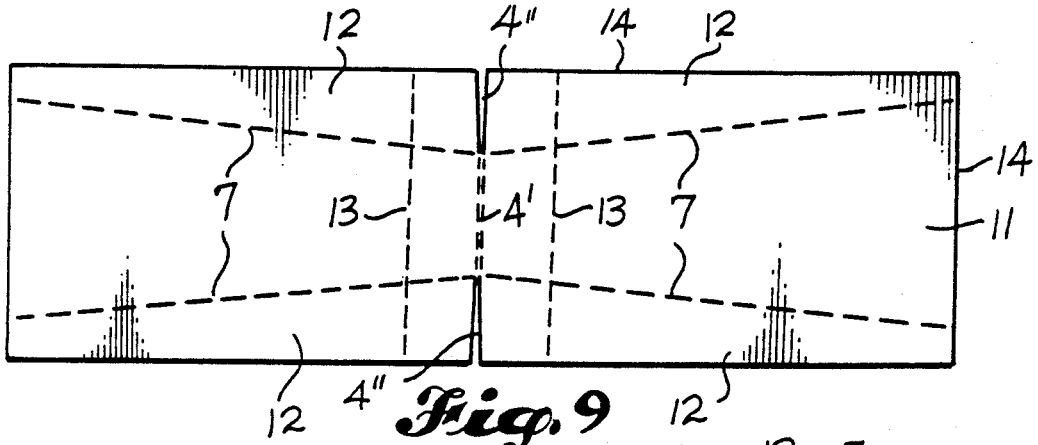
FIG. 9 is a plan of a double scoop component severed from the blank shown in FIG. 6 or FIG. 8.

FIG. 5 shows a cardboard dog food box in the shape of a rectangular parallelepiped that can be used to make several double scoop dog feces disposal components generally of the type shown in FIG. 9, and FIGS. 6 shows the box of FIG. 5 opened up and laid flat to form a flat blank composite panel arranged for fabricating several of such components from it. Each of the components to be produced from a box such as shown in FIG. 5 is designated 2' and includes two scoop leaves 3' connected in end-to-end relationship by a folding and tear line 4 as described in connection with FIG. 2.

The scoop leaves 3' of each double scoop component 2' are joined by the combined dividing, folding and tear line 4' in end-to-end relationship. Each line 4' may extend completely across the double scoop component 2' as shown in FIG. 6 and folding lines 7 diverge from locations spaced inward from the opposite ends of the line 4', respectively, toward the opposite corners of the scoop leaf ends. As shown in FIG. 9, the folding and tear line 4' can extend only between the folding lines 7 and the two leaves are actually severed at 4" along the portions of the line 4' outwardly of the folding lines 7. Such folding lines divide each scoop leaf 3' into a central panel 11 flaring away from the folding and tear line 4' and two side panels 12 joined contiguously edgewise to the central panel 11 and flaring toward the combined folding and tear line 4'.

As shown in FIGS. 5 and 6, the upright corners between a narrow side of the box and the two adjoining wide sides of the box form fold lines 13 spaced from but parallel to the dividing folding and tear lines 4' which are aligned along the center of such narrow box side. The corner fold lines 13 are unbent when the box is opened flat to form the blank shown in FIG. 6. Several double scoop component blanks 2' can be formed from the box by providing dividing or cutting lines 14 along the edge corners of the top and bottom of the box and along the upright corners of the box between the narrow side opposite the upright edge corners 13 and the adjoining wide sides of the box.

When the box shown in FIG. 5 is opened out flat to form the blank shown in FIG. 6, the projections 15 forming the bottom of the box can be severed as by cutting along the lower dividing lines 14 connecting them to the box body. Similarly, the projections 16 forming the top of the box can be severed along the upper dividing lines 14. Likewise the projections 17 which overlap partially to form the upright wall of the box opposite the wall having the combined dividing, folding and tear line 4' may be severed such as by being cut off. In the blank shown in FIG. 6, such operation will leave three double scoop components 2' joined in edge-to-edge relationship.

Instead of a single leaf being cut from the blank as shown in FIG. 6, it is preferred that the double scoop components 2' be separated from each other by cutting along the dividing lines 18 to make three double scoop components of the type shown in FIG. 9. The outer portions of the dividing, tear and folding lines 4' can then be severed by cutting in from the edge of each double scoop component to the folding lines 7 to form the scoop leaf separating slits 4", as shown in FIG. 9. While the dividing lines 4', 14 and 18 are shown as being on the outside of the box in FIG. 5, such lines, as well as fold lines 7, are preferably on the inside of the box so as to be visible only when the box shown in FIG. 5 is opened out flat to form the blank shown in FIG. 6, the side of which shown in that figure was the inside of the box shown in FIG. 5.

Figure 7:
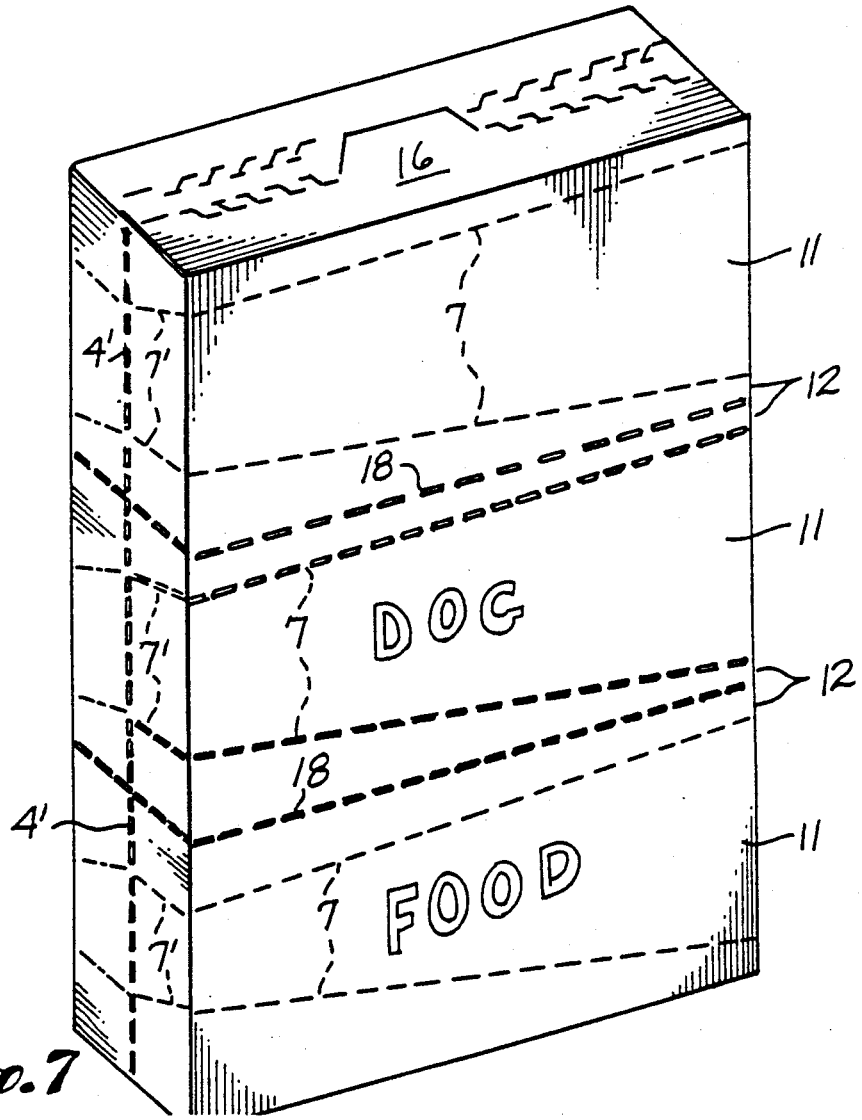
FIG. 7 is a top perspective of a petfood box similar to that shown in FIG. 5 but with a somewhat different construction.
Figure 8:
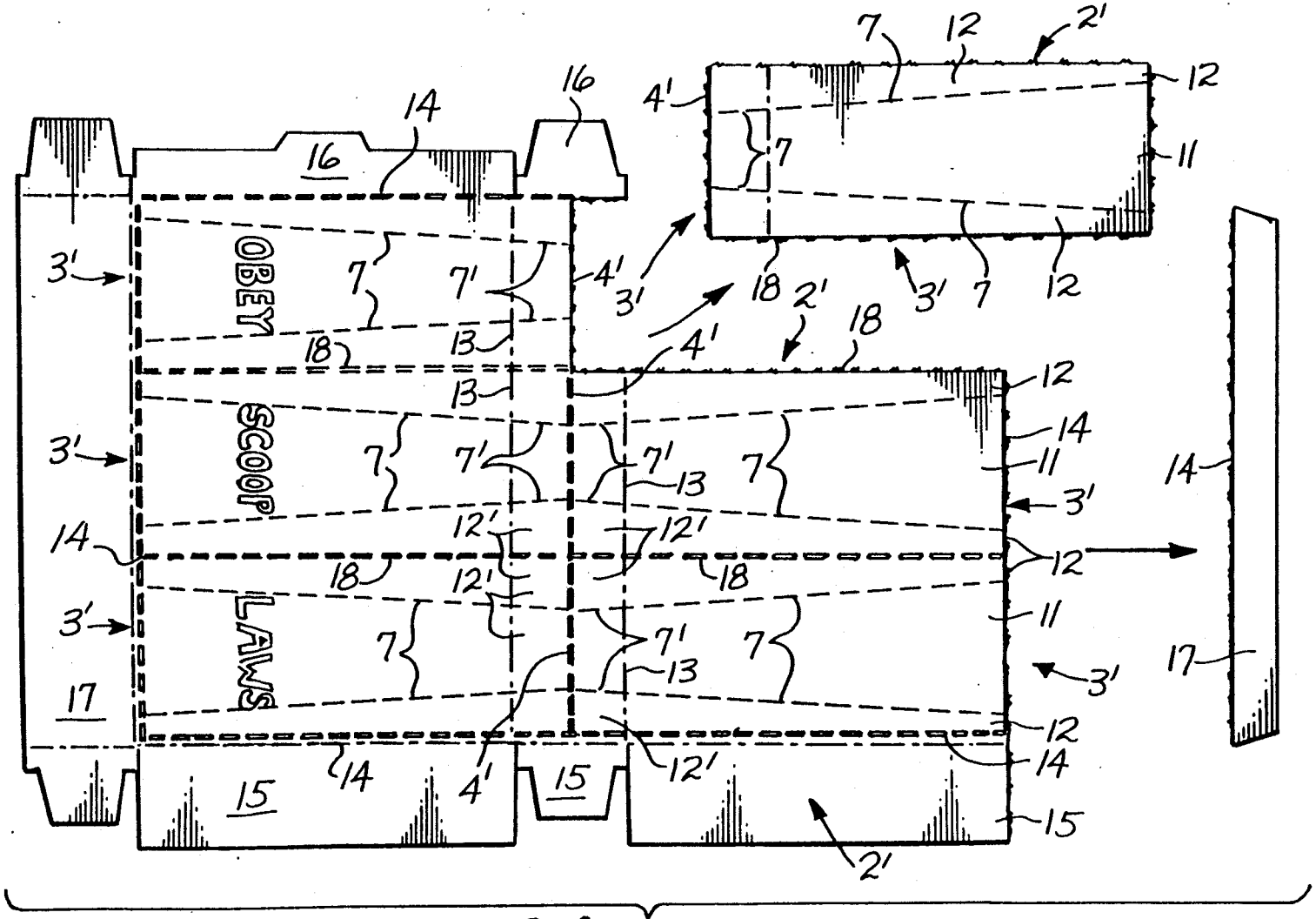
FIG. 8 is a plan of a blank made from a box like that shown in FIG. 7.

The box shown in FIG. 7 corresponds to that shown in FIG. 5 and the blank shown in FIG. 8 made from the box shown in FIG. 6 is comparable to the blank shown in FIG. 6. The difference is that in the box shown in FIG. 7 and in the blank shown in FIG. 8, dividing lines 14 and 18, as well as the portions of dividing lines 4' outwardly of the folding lines 7", are tear lines rather than being cutting lines. Consequently, the bottom portions 15 and top portions 16 of the box, as well as the end portions 17, can simply be torn from the remainder of the blank after which the double scoop elements can be torn apart along the dividing lines 18 to form components such as shown in FIG. 9.

Figure 10:
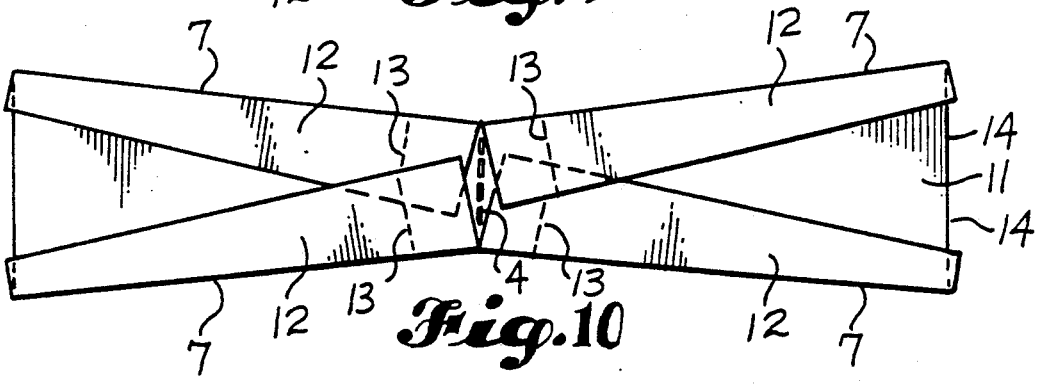
FIG. 10 is a plan of the same double scoop component with parts folded.
Figure 11:
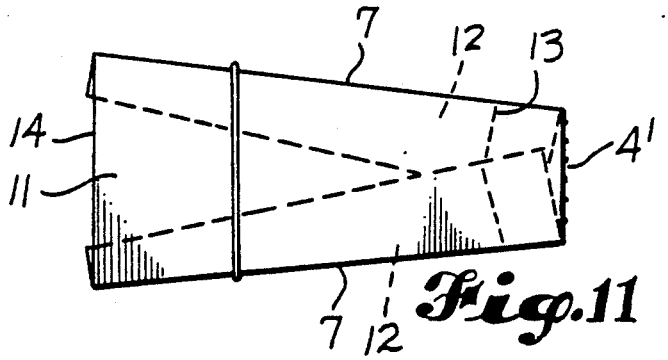
FIG. 11 is a plan of the double scoop component shown in FIG. 10 with the two scoop components doubled folded and FIG. 12 is a plan showing the two scoop parts of the double scoop component separated.

After the double scoop components have been separated from each other, as shown in FIG. 9, the panels 12 of each scoop leaf can be folded over the central panel 11, as shown in FIG. 10. Next, the two scoop leaves can be double folded from the relationship shown in FIG. 10 to that shown in FIG. 11 with the panels 12 on the inside of the double fold. The two leaves of the double scoop component can be held in such double-folded condition by an elastic band, if desired, as shown in FIG. 11.

Figure 13:
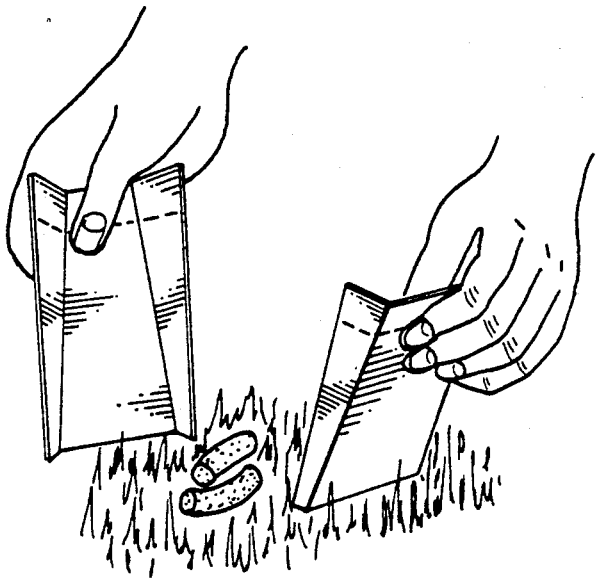
FIG. 13 is a top perspective of the two scoops shown in FIG. 12 in use.
Figure 12:
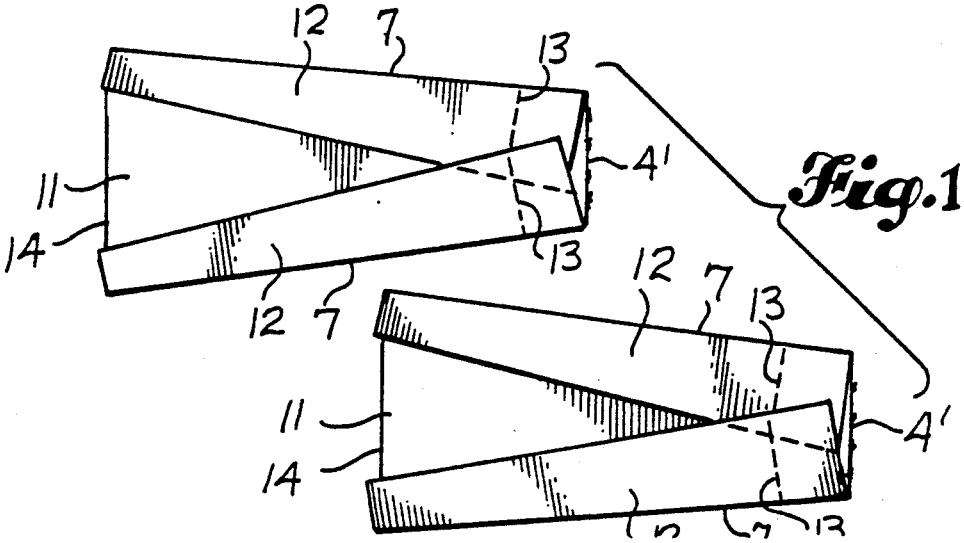

When it is desired to use two scoops for picking up feces such as in the manner illustrated in FIG. 13, the two scoop leaves 3' of a double scoop component 2' can be separated by tearing along the combined folding and tear line 4' connecting them, as indicated in FIG. 12. Each scoop can be formed from a leaf 3' by bending the side panels 12 open relative to the central panel 11 along the folding lines 7 through an angle of 90 degrees or more into the shape indicated in FIG. 13.

Although the box edge corner folding line 13 extends entirely across the width of the leaf 3' between its opposite longitudinal edges, as shown in FIGS. 6 and 8, to form short folding lines 7' for the side panels of the scoop blank between the corner edge fold line 13 and the combined folding and tear line 4', such corner edge fold line is not detrimental to the rigidity of the scoop constructed. The trough-shaped scoop produced by folding the side panels 12 along the folding lines 7 and 7' will rigidify or stiffen the prior fold along corner edge fold line 13 so that the trough-shaped scoop formed will be substantially as rigid when the scoops are used in a scooping operation as illustrated in FIG. 13 as it would have been if the box corner edge fold line 13 had not been present.

If the box were sufficiently large so that it was not necessary to include any of the narrower sides of the box in scoop blanks, the corner fold lines 13 could be made dividing lines so that the length of the scoop blanks would extend only along the widths of the wider sides, and the narrower sides of the box between the corner fold lines 13 could be severed from the wider sides and discarded. In such case, the corner fold lines 13 could be made as tear lines if desired and the folding and tear line 4' and folding lines 7' would be omitted. In such case, two scoop elements with their side panels 12 folded over their central panels 11 could be secured together, as shown in FIG. 11, without being joined by the folding and tear line 4', or one of such scoop elements could be reversed end for end so that the two scoop elements would not be in complete registration, but such scoop elements could be secured together by an elastic band encircling both of them. When such scoop elements are to be prepared for use, they are simply separated and unfolded, as discussed above in connection with FIG. 13.

The tear lines and the folding and tear lines shown in FIGS. 7 and 8 may be sufficiently porous that they are not airtight. Under such circumstances it may be desirable for the food contents of the box shown in FIG. 7 to be contained in a flexible sealed liner within the box, such as of waxed paper.

I claim:

1. In a dog feces disposal implement kit, a double scoop component including two scoop leaves extending oppositely from each other and having adjacent ends joined by means including a folding and tear line, and at least one of said leaves having spaced folding lines extending from such folding and tear line toward the end of such leaf opposite said folding and tear line.

2. In the dog feces disposal implement kit double scoop component defined in claim 1, both of the leaves having spaced folding lines extending from the folding and tear line toward the ends of the leaves opposite the folding and tear line.

3. In the dog feces disposal implement kit double scoop component defined in claim 2, in which each leaf includes opposite side panels folded over a central panel along the folding lines, the folded leaves being double folded together about the folding and tear line with the side panels folded between the central panels of the two leaves, and means for holding the double scoop component in such double-folded condition.

4. In a dog feces disposal implement kit, a double scoop component including two scoop leaves extending oppositely from each other and having adjacent ends by means including a folding and a tear line, and at least one of said leaves having spaced folding lines extending from such folding and tear line toward the end of such leaf opposite said folding and tear line, said double scoop component being fabricated from a rectangular parallelpiped cardboard box and having a box edge corner folding line extending across the width of a leaf parallel to the folding and tear line and intersecting the folding lines of such leaf.

5. A dog feces disposal scoop component blank comprising a plurality of coplanar scoop components joined in edge-to-edge relationship by generally parallel dividing lines and each scoop component having between adjacent dividing lines two folding lines defining a central panel and two edge panels foldable relative to said central panel.

6. The blank defined in claim 5, in which two scoop components are joined in end-to-end relationship by a folding and tear line to form a double scoop component.

7. A dog feces disposal scoop component made from a cardboard box having adjacent sides and a box corner fold lines between such adjacent sides comprising a quadrilateral scoop blank leaf formed by at least portions of such two adjacent sides of the box, and said scoop blank leaf extending across the box corner fold line to opposite sides of the box corner fold line so that the box corner fold line extends across said scoop blank leaf between opposite edges of said scoop blank leaf, and said scoop blank leaf having folding lines crossing the box corner fold line.

8. A dog feces disposal scoop component made from a rectangular parallelpiped cardboard box having adjacent sides and a corner fold line between such adjacent sides, comprising a leaf including a central panel extending across the box corner fold line and two side panels extending along opposite sides of said central panel and also extending across the box corner fold line, said side panels being folded relative to said central panel for forming a trough extending across the box corner fold line for holding the sections of said central panel on opposite sides of the box corner fold line in coplanar relationship.

9. In a dog feces disposal implement kit, a flat blank composite panel having parallel opposite edges and formed from an unfolded rectangular parallelepiped box having two corner fold lines parallel to each other and parallel to such opposite edges of said flat blank composite panel, said composite panel including a central panel and two side panels adjacent to and at opposite sides of said central panel, said flat blank composite panel comprising two scoop components including two leaves, respectively, extending oppositely from each other, each leaf being formed by a portion of said central panel and portions of said two side panels, respectively, so that a corner fold line extends across each of said leaves, said leaves having adjacent ends joined by means including a folding and tear line disposed between and parallel to the corner fold lines and each of said leaves having folding lines extending from said folding and tear line across its respective corner fold line to one of such bland edges for folding of each leaf into trough shape for thereby maintaining the portions of each leaf at opposite sides of its respective corner fold line in aligned relationship.

* * * * *